US011357305B2

(12) United States Patent
Giancaspro et al.

(10) Patent No.: US 11,357,305 B2
(45) Date of Patent: Jun. 14, 2022

(54) MOLDABLE HEATED EYELASH CURLER

(71) Applicant: Innovative Cosmetics Enterprises, LLC, Higley, AZ (US)

(72) Inventors: Linda Giancaspro, Gilbert, AZ (US); Mario A. Esquer, Scottsdale, AZ (US)

(73) Assignee: INNOVATIVE COSMETICS ENTERPRISES, LLC, Higley, AZ (US)

( * ) Notice: Subject to any disclaimer, the term of this patent is extended or adjusted under 35 U.S.C. 154(b) by 181 days.

(21) Appl. No.: 16/712,801

(22) Filed: Dec. 12, 2019

(65) Prior Publication Data

US 2021/0076795 A1 Mar. 18, 2021

Related U.S. Application Data

(60) Provisional application No. 62/784,166, filed on Dec. 21, 2018.

(51) Int. Cl.
*A45D 2/48* (2006.01)
*A45D 2/36* (2006.01)

(52) U.S. Cl.
CPC ..... *A45D 2/48* (2013.01); *A45D 2/367* (2013.01); *A45D 2200/155* (2013.01)

(58) Field of Classification Search
CPC ..... A45D 2/48; A45D 2/267
USPC ..... 362/115
See application file for complete search history.

(56) References Cited

U.S. PATENT DOCUMENTS 1,951,130 A * 3/1934 Cohn ..... A45D 2/48 132/217
2,854,668 A * 9/1958 McMillan ..... H01Q 1/422 343/872
4,784,165 A * 11/1988 Stein ..... A45D 2/48 132/217

(Continued)

FOREIGN PATENT DOCUMENTS

CN 2380088 5/2000
CN 203314330 12/2013

(Continued)

OTHER PUBLICATIONS

Laura Mercier, Eyelash Curler: https://orchardmile.com/laura-mercier/eyelash-curler-c6750db4700?gclid=CjwKCAiA58fvBRAzEiwAQW-hzQIPXI_qoi7uoLZvngiXV9cdlxGoJxDHRMk2sYdPPf3Wso1w8iD_thoCxWEQAvD BwE.

(Continued)

*Primary Examiner* — Rachel R Steitz
(74) *Attorney, Agent, or Firm* — Booth Udall Fuller, PLC

(57) ABSTRACT

An eyelash curler comprising a handle, an actuator, and a curling head. The handle has an elongated shape with a top end and a bottom end. The actuator is embedded within the handle with a switch exposed on the surface of the handle and an actuator stem extending from the top end of the handle. Manipulating the switch moves the actuator between a first position and a second position. The curling head has only one support bar, a first curler arm coupled to the end of the support bar, and a second curler arm coupled to the top end of the actuator stem. When the actuator is in the first position, the second curler arm is in contact with the top end of the handle and when the actuator is in the second position, the second curler arm is in contact with the first curler arm.

19 Claims, 9 Drawing Sheets

(56) References Cited

U.S. PATENT DOCUMENTS

| | | | | |
|---|---|---|---|---|
| 5,685,324 | A * | 11/1997 | Huang | A45D 2/48 132/216 |
| 6,230,715 | B1 * | 5/2001 | Cho | A45D 2/48 132/216 |
| 7,055,529 | B2 | 6/2006 | Muraki et al. | |
| 8,366,288 | B1 | 2/2013 | Lin | |
| 2007/0267036 | A1 * | 11/2007 | Cho | A45D 2/48 132/217 |
| 2009/0005673 | A1 | 3/2009 | Suhjeong-Joo | |
| 2009/0255548 | A1 | 10/2009 | Lin | |
| 2012/0097181 | A1 * | 4/2012 | Miles | A45D 2/48 132/217 |

FOREIGN PATENT DOCUMENTS

| | | |
|---|---|---|
| JP | 2002028020 | 1/2002 |
| KR | 100988381 | 10/2010 |
| KR | 2016000651 | 1/2016 |
| KR | 2018007280 | 6/2018 |
| KR | 20180062599 | 6/2018 |

OTHER PUBLICATIONS

Heated Eyelash Curler—Automatic, Battery Operated, Easy to Use, Suitable for All Lashes, Long Lasting, Slim and Portable, ABS Material, Perm Curler: https://www.amazon.com/dp/B07F6WPY9Z/ref=sspa_dk_detail_7?psc=1&pd_rd_i=B07F6WPY9Z.

* cited by examiner

MOLDABLE HEATED EYELASH CURLER

CROSS REFERENCE TO RELATED APPLICATIONS

This application claims the benefit of the filing date of U.S. Provisional Patent Application 62/784,166 entitled "Moldable Heated Eyelash Curler" to Linda Giancaspro that was filed on Dec. 21, 2018, the disclosure of which is hereby incorporated herein by this reference.

TECHNICAL FIELD

Aspects of this document relate generally to a moldable heated eyelash curler.

BACKGROUND

Curling eyelashes is a century old practice with prior art in the US dating back to before the turn of the 20th century. The purpose of the eyelash curler is to accentuate the eyelash by changing the natural shape to a more visible form. It is desirable for the eyelash to remain in the new shape for an extended period time, often up to 18 hours without reforming.

Eyelash curlers are known in the beauty industry. Conventional eyelash curlers, however, are known to pinch the middle or edges of the eye of the user if the eyelash crimper doesn't exactly match the shape of the wearer's eye. Eye shape is a very personal trait and people have widely varied eye shapes and contours, so eyelash curler manufacturers match average eye shapes as an alternative to creating a unique shape for each user.

Conventional products are comprised of at least two interfacing parts that form the eyelash to a desired shape. As the two interfacing parts are pressed against the eyelash, contact between the apparatus and the eyelid can pinch the skin causing pain and discomfort. Eye sockets and eyelids are not all shaped the same nor do they share the same physical dimensions making it difficult for a single apparatus to curl the eyelash to the desired shape. To compensate for a generic apparatus shape that does not conform to the eye socket or eyelid, users are required to repeatedly form small sections of the eyelash to achieve the desired shape. Furthermore, conventional products depend on sharp edges and interfacing compliant materials to provide a lasting curl; however, the sharp edges can damage the eyelash via crimping or breakage as significant force is required to apply the desired shape. The force required to form the eyelash can also cause discomfort for the user given conventional user interface approaches.

SUMMARY

According to an aspect of the disclosure, an eyelash curler may comprise a handle having an elongated shape with a top end and a bottom end opposite the top end, the handle containing a battery compartment adjacent the bottom end with a battery therein, an actuator embedded within the handle, the actuator having a switch exposed on a surface of the handle and an actuator stem having a top end extending from the switch through the top end of the handle, wherein manipulation of the switch moves the actuator between a first position and a second position, and a curling head having only one support bar centered on and extending upward from the top end of the handle, the curling head further comprising a first curler arm fixedly coupled to an end of the support bar, and a second curler arm coupled to the top end of the actuator stem and slidably attached to the support bar through an attachment guide that directly engages the support bar, wherein each of the first curler arm and the second curler arm has a core formed of a first material and extending along the length of the curler arm and an outer layer formed of a second material and surrounding the core, wherein the first material forming the core is harder than the second material surrounding the core, wherein when the actuator is in the first position, the second curler arm is in contact with the top end of the handle and when the actuator is in the second position, the second curler arm is in contact with the first curler arm, and wherein the curling head is electrically coupled to the battery and configured to heat when power is supplied to the curling head.

Particular embodiments may comprise one or more of the following features. The core of each of the first curler arm and the second curler arm may be malleable and configured to assume a new shape in response to pressure applied to either of the first curler arm or the second curler arm. The curler arms may be removable from the curling head. The second material may be a heat-conductive material. The cores of the first curler arm and the second curler arm may be formed of a plurality of core segments pivotally coupled together. The cores of the first curler arm and the second curler arm may be formed of a single, continuous malleable material. The actuator may be biased toward the first position.

According to an aspect of the disclosure, an eyelash curler may comprise a handle having an elongated shape with a top end and a bottom end opposite the top end, an actuator embedded within the handle, the actuator having a switch exposed on a surface of the handle and an actuator stem having a top end extending from the switch through the top end of the handle, wherein manipulation of the switch moves the actuator between a first position and a second position, and a curling head having at least one support bar extending upward from the top end of the handle, the curling head further comprising a first curler arm fixedly coupled to an end of the at least one support bar, and a second curler arm coupled to the top end of the actuator stem and slidably attached to the at least one support bar through an attachment guide that directly engages the support bar, wherein each of the first curler arm and the second curler arm has a core formed of a first material that extends along the length of the curler arm and an outer layer formed of a second material that surrounds the core, wherein the first material forming the core is harder than the second material surrounding the core, wherein when the actuator is in the first position, the second curler arm is in contact with the top end of the handle and when the actuator is in the second position, the second curler arm is in contact with the first curler arm, and wherein the core of each of the first curler arm and the second curler arm is malleable and configured to assume a new shape in response to pressure applied to either of the first curler arm or the second curler arm.

Particular embodiments may comprise one or more of the following features. The curler arms may be removable from the curling head. The cores of the first curler arm and the second curler arm may be formed of a plurality of core segments pivotally coupled together. The cores of the first curler arm and the second curler arm may be formed of a single, continuous malleable material. The actuator may be biased toward the first position. The handle may contain a battery compartment adjacent the bottom end with a battery, wherein a charging port in the bottom end of the handle is electrically coupled to the battery and the curling head is electrically coupled to the battery and configured to heat when power is supplied to the curling head. The second material may be a heat-conductive material.

According to an aspect of the disclosure, an eyelash curler may comprise a handle having an elongated shape with a top end and a bottom end opposite the top end, an actuator embedded within the handle, the actuator having a switch exposed on a surface of the handle and an actuator stem having a top end extending from the switch through the top end of the handle, wherein manipulation of the switch moves the actuator between a first position and a second position, and a curling head having a support bar extending upward from the top end of the handle, the curling head further comprising a first curler arm coupled to an end of the support bar, and a second curler arm coupled to the top end of the actuator stem, wherein each of the first curler arm and the second curler arm has a core formed of a first material that extends along the length of the curler arm and an outer layer formed of a second material that surrounds the core, wherein the first material forming the core is harder than the second material surrounding the core, wherein when the actuator is in the first position, the second curler arm is in contact with the top end of the handle and when the actuator is in the second position, the second curler arm is in contact with the first curler arm.

Particular embodiments may comprise one or more of the following features. The support bar of the curling head may be only one support bar. The only one support bar may be centered on the top end of the handle. The handle may contain a battery compartment adjacent the bottom end with a battery, wherein a charging port in the bottom end of the handle is electrically coupled to the battery and the curling head is electrically coupled to the battery and configured to heat when power is supplied to the curling head. The actuator may be biased toward the first position. The second curler arm may be slidably attached to the support bar through an attachment guide that directly engages the support bar.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that he can be his own lexicographer if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This document features a moldable heated eyelash curler. There are many features of an eyelash curler and method implementations disclosed herein, of which one, a plurality, or all features or steps may be used in any particular implementation.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

Figure 1:
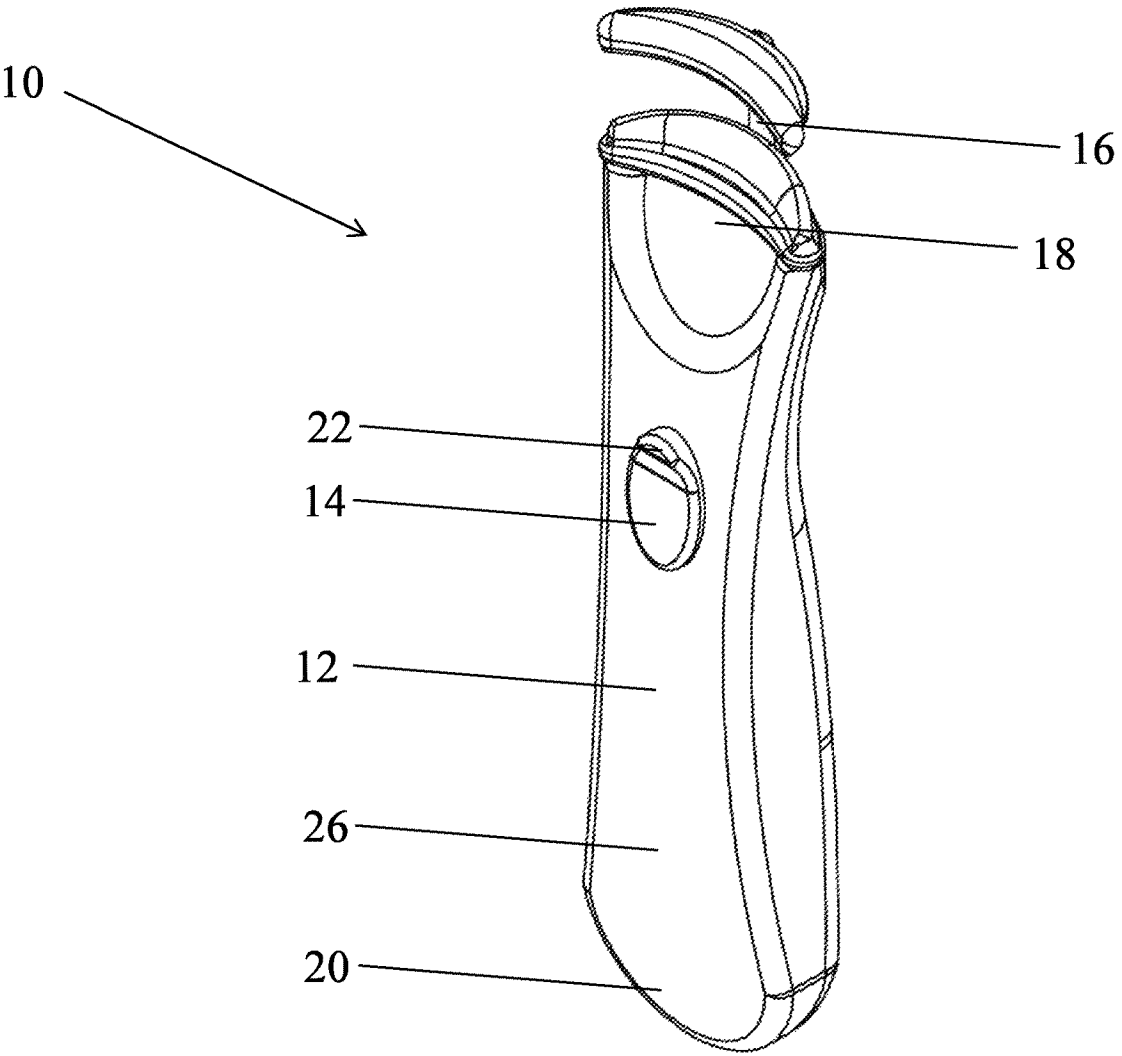
FIG. 1 is a front perspective view of an implementation of the eyelash curler.
Figure 2:
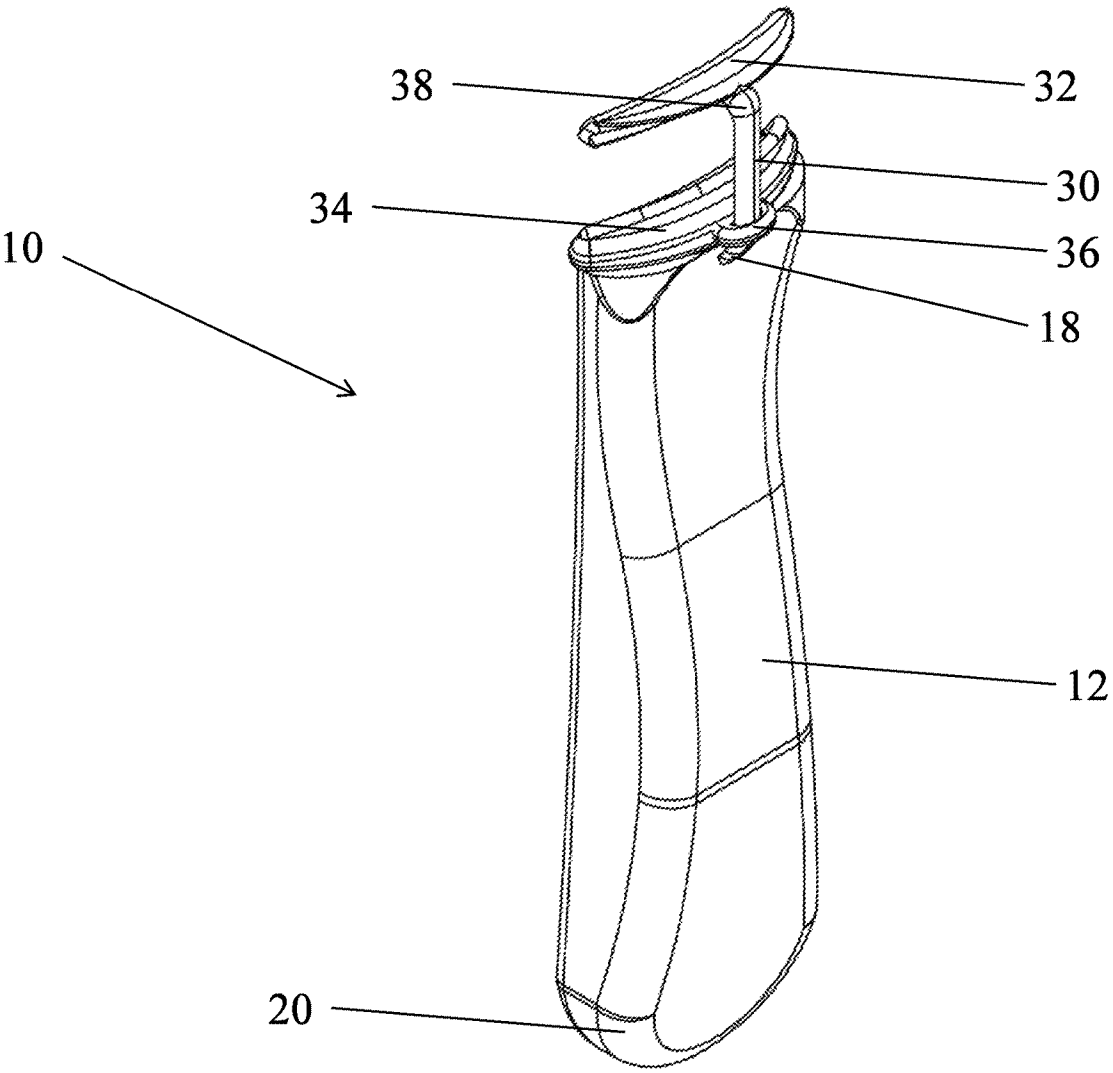
FIG. 2 is a back perspective view of the eyelash curler of FIG. 1.

FIGS. 1-2 depict an implementation of the eyelash curler 10. The implementation shown has a handle 12, an actuator 14, and a curling head 16. The handle 12 may have an elongated shape with a top end 18 and a bottom end 20 opposite the top end 18. In addition, the handle 12 may contain a battery compartment with a battery (not shown) adjacent the bottom end 20. The actuator 14 may have a switch 22 and an actuator stem 24 (see FIG. 3B). A majority of the actuator 14 may be embedded within the handle 12, with the switch 22 exposed on the surface 26 of the handle 12. The actuator stem 24 may have a top end 28 that extends through the top end 18 of the handle 12.

The curling head 16 may have a support bar 30, a first curler arm 32, a second curler arm 34, and an attachment guide 36. The support bar 30 may be centered on the top end 18 of the handle 12, and may extend upward from the top end 18 of the handle 12. Alternatively, there may be more than one support bar 30 (see FIG. 8). In some implementations, there is only one support bar 30. The first curler arm 32 may be coupled to the end 38 of the support bar 30 and the second curler arm 34 may be coupled to the top end 28 of the actuator stem 24 (see FIG. 3B) and slidably attached to the support bar 30 through the attachment guide 36. The attachment guide 36 may directly engage the support bar 30 by wrapping around or clipping onto the support bar 30. In some implementations, the curler arms 32, 34 may be removable from the curling head 16 (see FIG. 8). This allows the curler arms 32, 34 to be easily replaced if needed.

Figure 3A:
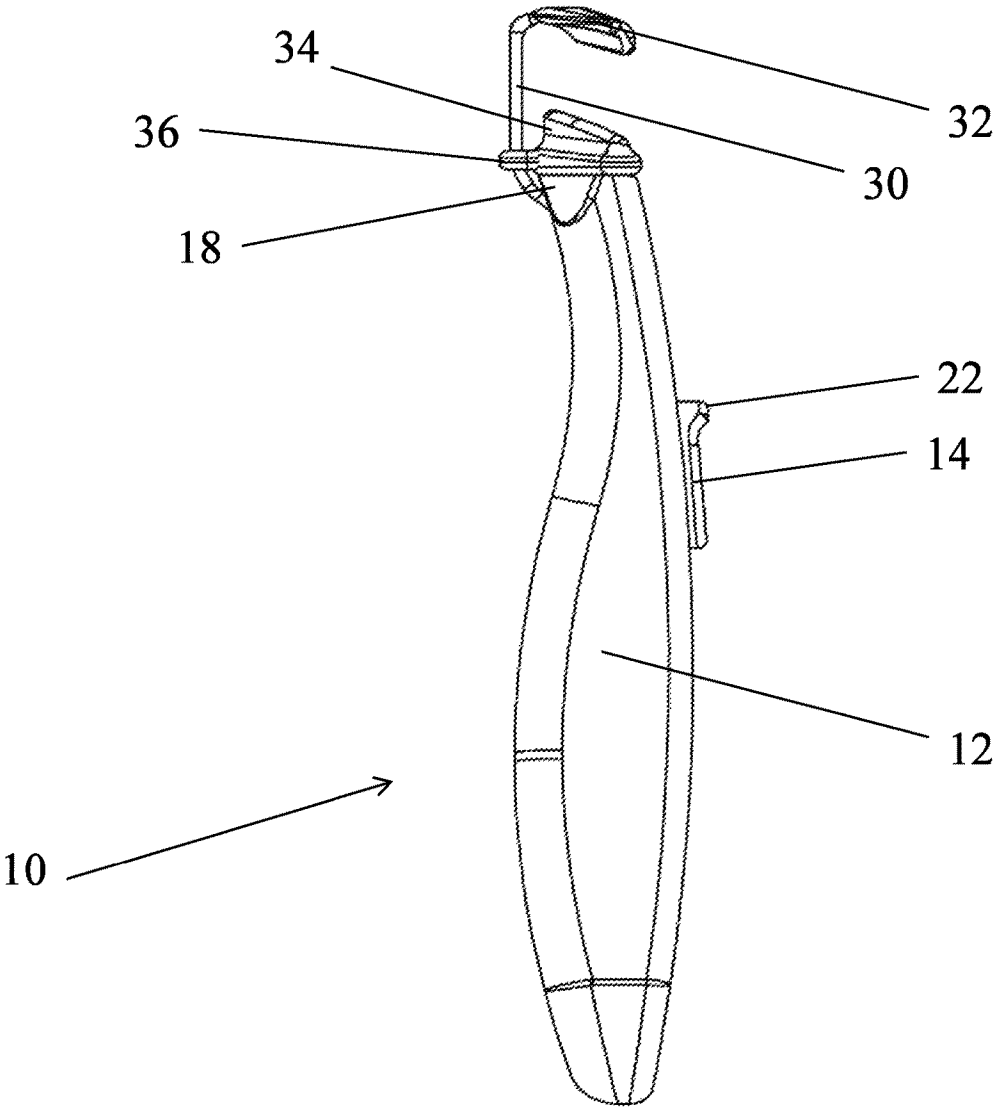
FIG. 3A is a side view of the eyelash curler of FIG. 1, showing the actuator stem in the first position.
Figure 3B:
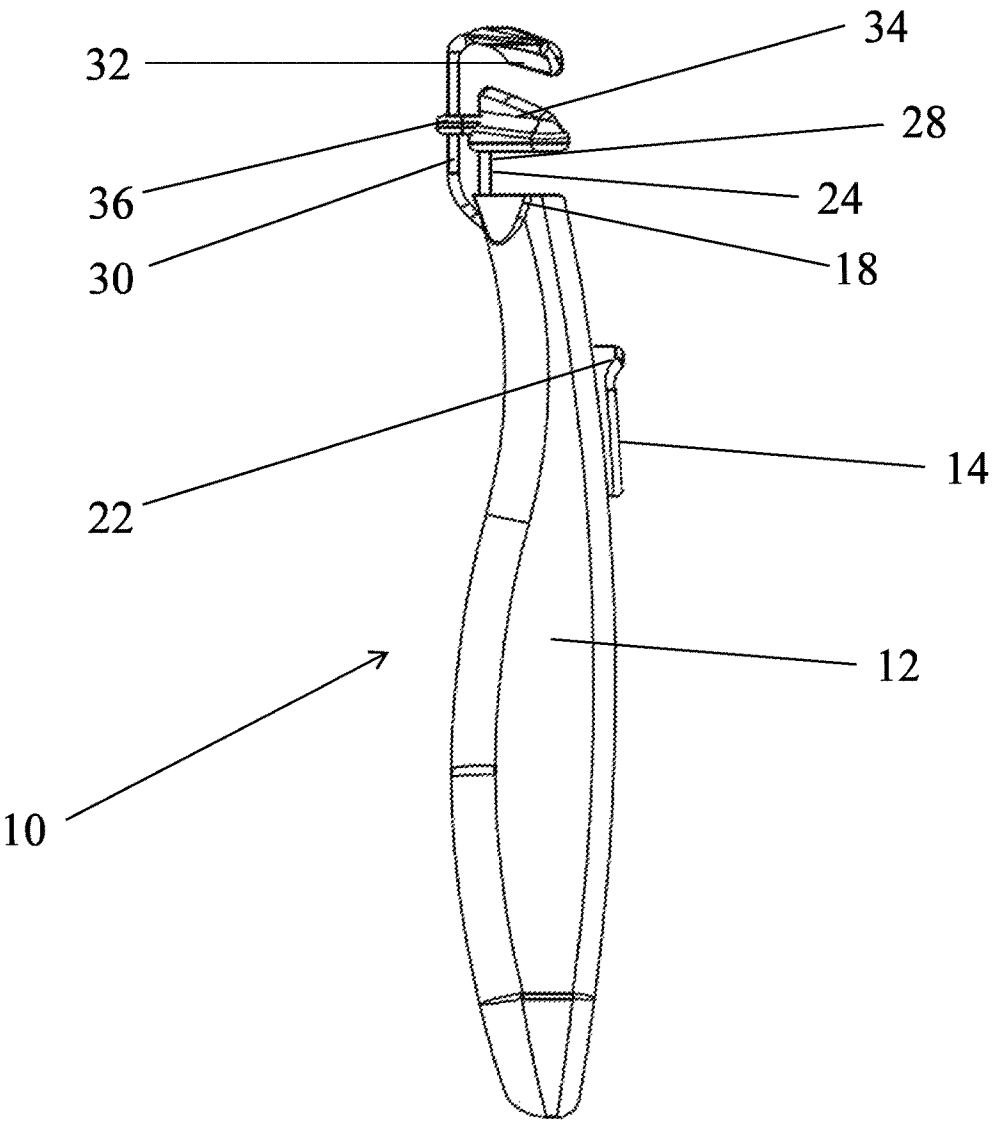
FIG. 3B is a side view of the eyelash curler of FIG. 1, showing the actuator stem in the second position.
Figure 4:
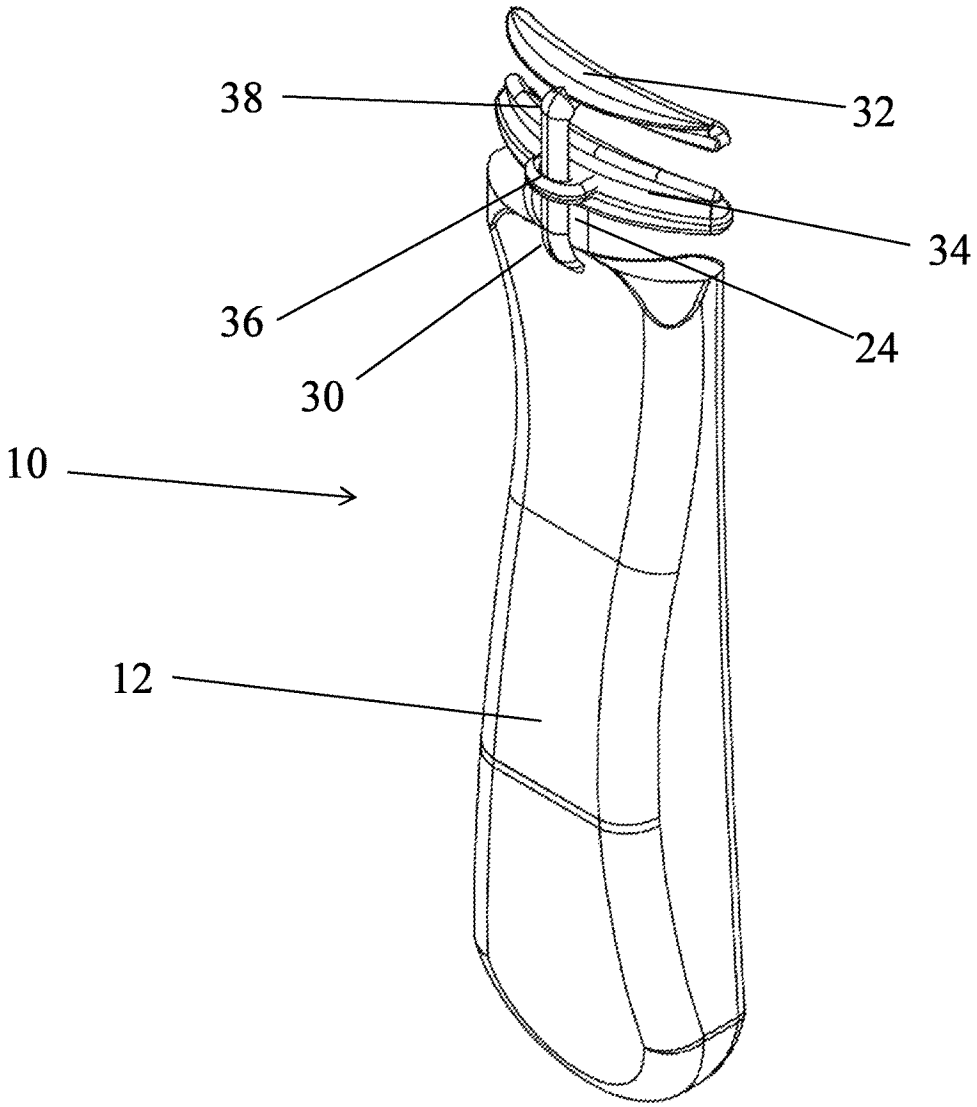
FIG. 4 is a back perspective view of the eyelash curler of FIG. 1, showing the actuator stem in the second position.

FIG. 3A, FIG. 3B, and FIG. 4 depict the implementation of the eyelash curler 10 shown in FIGS. 1-2, with the actuator 14 in two different positions. When the actuator 14 is in the first position 40 (shown in FIG. 3A), the second curler arm 34 is adjacent to or even in contact with the top end 18 of the handle 12. When the actuator 14 is in the second position 42 (shown in FIG. 3B), the second curler arm 34 is adjacent to or in contact with the first curler arm 32. The actuator 14 may be biased toward the first position 40. To switch from the first position 40 to the second position 42, the switch 22 may be engaged. When pushed upward, the switch 22 also moves the actuator 14 in the same direction, thus lifting the second curler arm 34 up towards the first curler arm 32. The attachment guide 36 guides the second curler arm 34 so that it follows the path provided by the support bar 30. Therefore, to use the eyelash curler 10, the eyelash curler 10 is placed so that an eyelash is located between the first curler arm 32 and the second curler arm 34. The switch 22 can then be manipulated, causing the second curler arm 34 to rise towards the first curler arm 32. The eyelash is thus squeezed between the first curler arm 32 and the second curler arm 34, assuming the desired shape.

Figure 5:
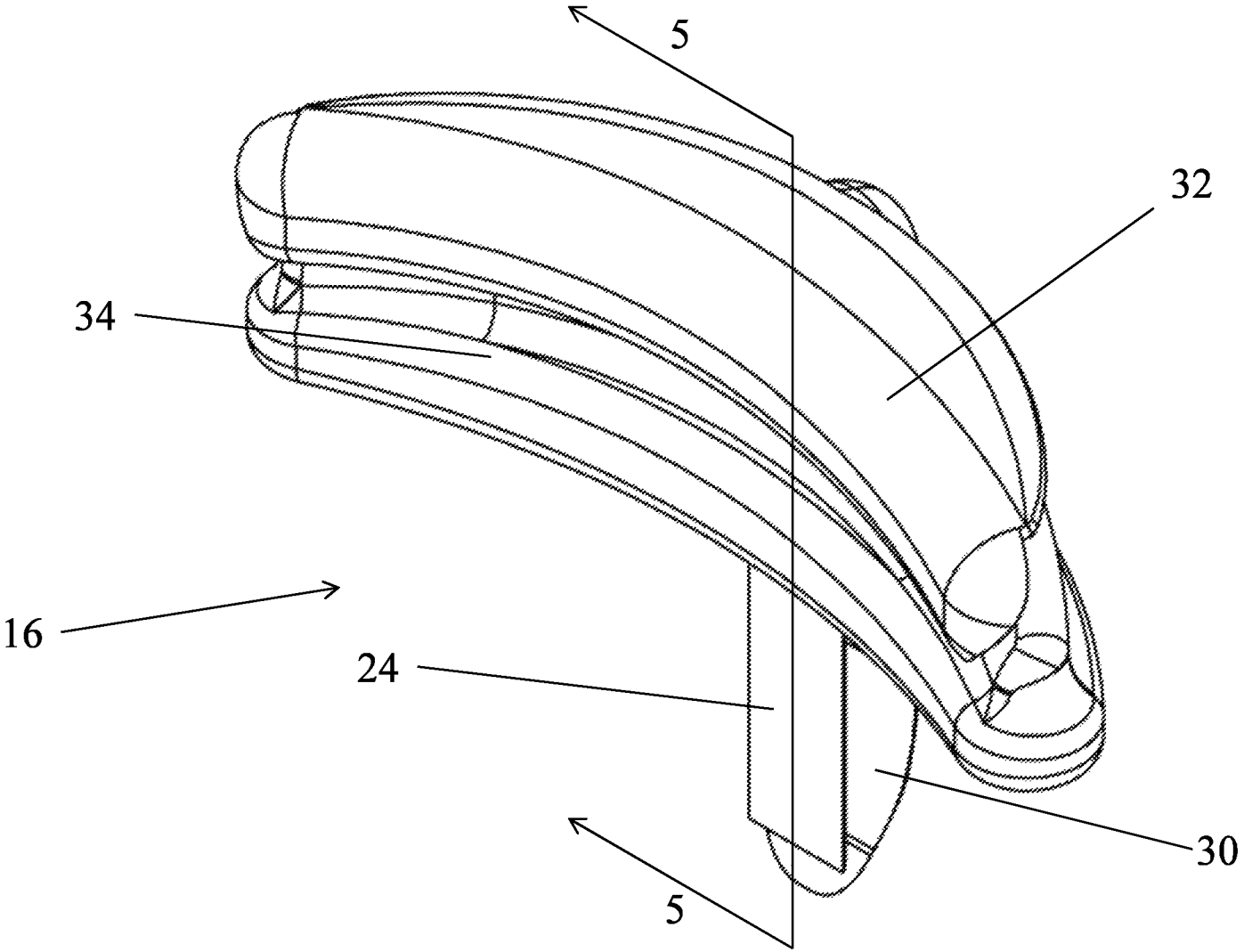
FIG. 5 is a perspective view of a curling head of the eyelash curler of FIG. 1, isolated from the handle.
Figure 6:
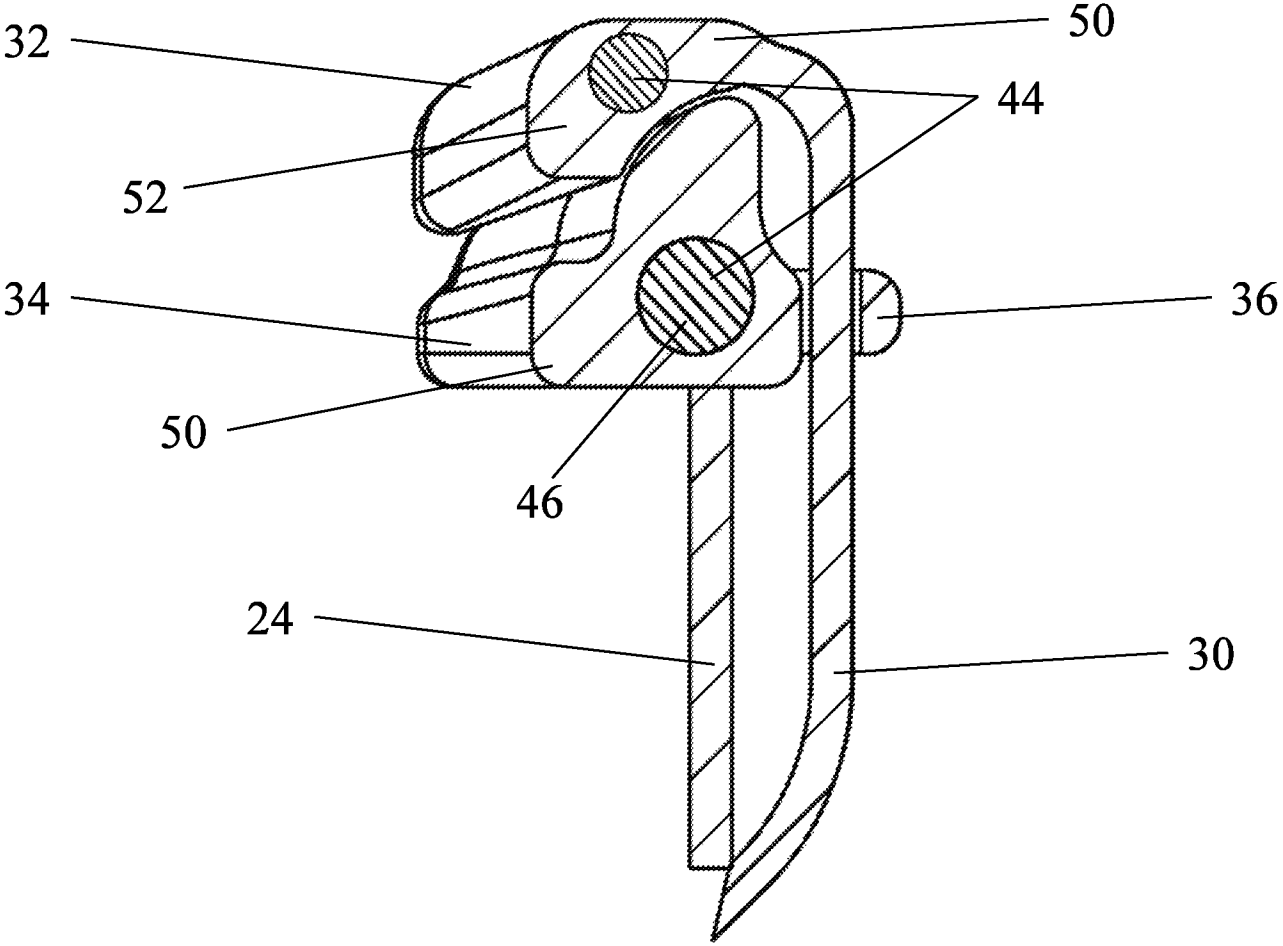
FIG. 6 is a section view of the curling head of FIG. 5 taken along line 5-5.
Figure 7:
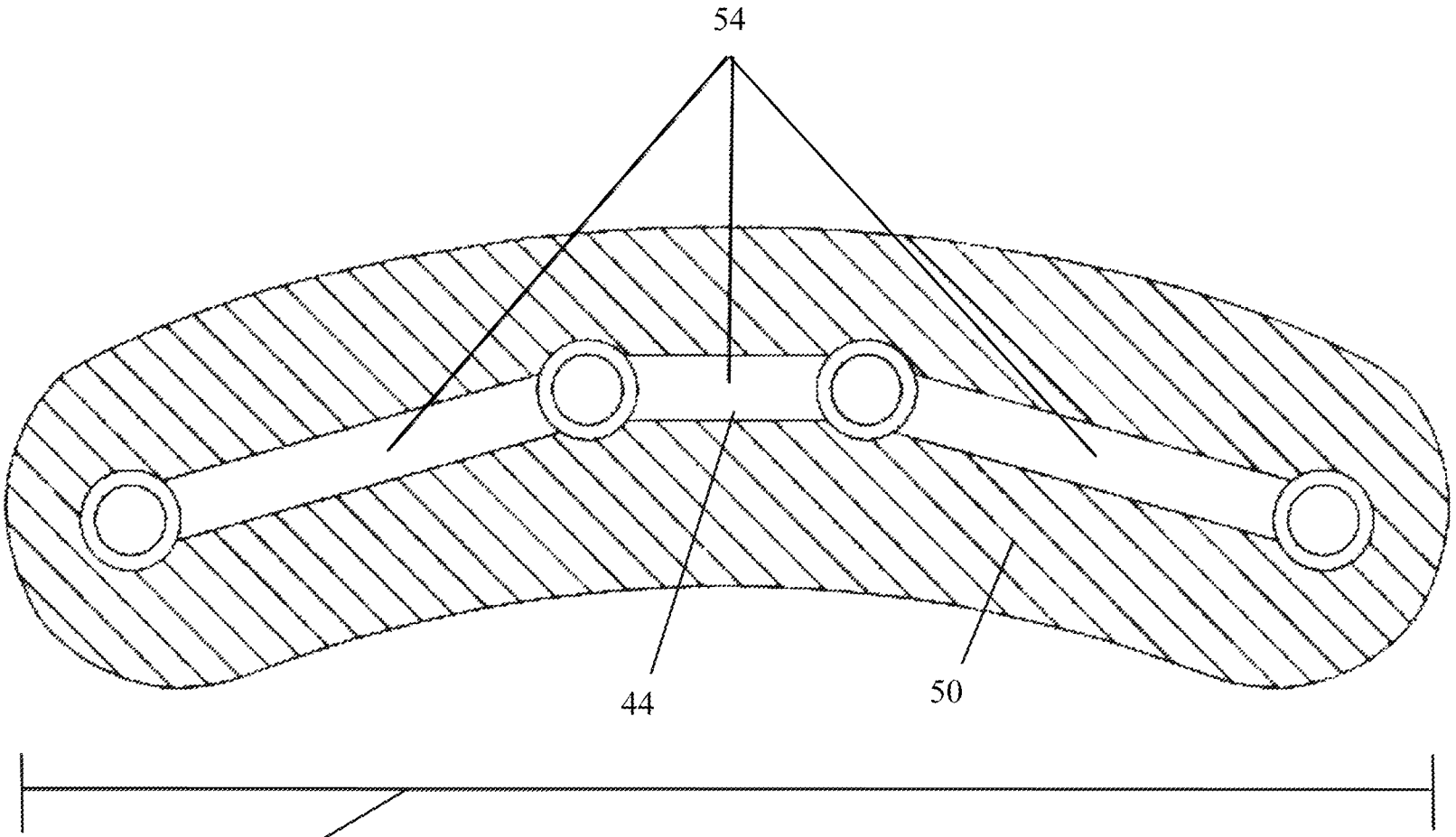
FIG. 7 is a section view of a curler arm of an eyelash curler implementation where the core of the curler arm is formed of a plurality of core segments.

FIGS. 5-6 depict the curling head 16 of the eyelash curler 10 from FIGS. 1-2. Each of the first curler arm 32 and the second curler arm 34 may have a core 44 formed of a first material 46. The core 44 may extend along the length 48 (see FIG. 7) of the curler arm 32, 34. Additionally, each of the curler arms 32, 34 may have an outer layer 50 surrounding the core 44 that is formed of a second material 52. The first material 46 may have a hardness that is greater than a hardness of the second material 52. Thus, the core 44 provides structure and form to the curler arms 32, 34 while the outer layer 50 makes the curler arms 32, 34 more comfortable for the eye. In addition, the first material 46 may have material properties that make the core 44 malleable and capable of being manipulated into different shapes in response to pressure. This allows the curler arms 32, 34 to be adapted to different eye shapes. FIG. 7 shows a curler arm 32, 34 of an implementation of the eyelash curler 10 where the core 44 of the curler arm 32, 34 is formed of a plurality of core segments 54. The core segments 54 may allow the core 44 to be more flexible in assuming desired shapes as having joints requires less flexing from the actual core material. Alternatively, the core 44 may be formed of a single, continuous material with no joints. In such a case, the core 44 derives all of its flexibility from the material properties of the first material 46.

Figure 8:
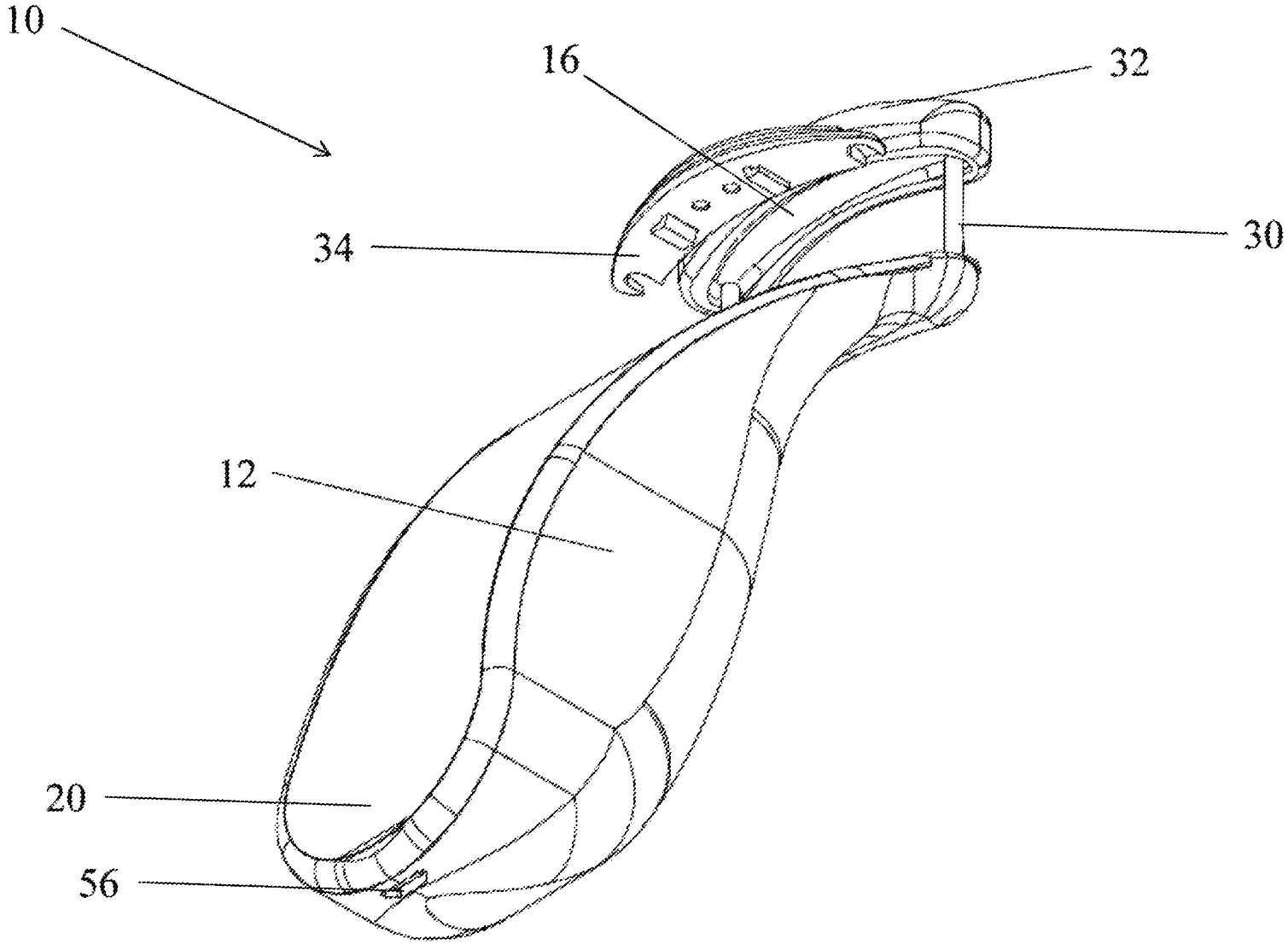
FIG. 8 is a bottom perspective view of an eyelash curler implementation with a charging port in the handle.

FIG. 8 depicts an implementation of the eyelash curler 10 with a charging port 56 in the bottom end 20 of the handle 12. The handle may additionally have a battery compartment with a battery (not shown) electrically coupled to the charging port 56. The charging port 56 may also be electrically coupled to the curling head 16. The curling head 16 may be configured to heat when power is supplied to the curling head 16 either through the charging port 56 or the battery. The second material 52 may be a heat-conductive material to facilitate uniform heating of the curling head 16. Heating the curling head 16 allows the curling head 16 to more effectively curl eyelashes with a longer lasting curl. The embodiment illustrated in relation to FIGS. 1-7 similarly includes a charging port, though it is not specifically shown at that angle in the Figures.

The first curler arm 32 and the second curler arm 34 have shapes that are adjustable, allowing each curler arm to be shaped to fit the eyelash as desired. This allows the user to avoid pinching the skin around the eye that typically results from using a conventional eyelash curler. In addition, having only one support bar 30, as illustrated in FIGS. 1-7, may allow the user greater flexibility in placing the eyelash curler 10 around the eye, as the user is not forced to place the eyelash between two support bars 30 as is common in conventional eyelash curlers. However, in FIG. 8, an embodiment is illustrated that uses two support bars 30 to illustrate that two separate support bars at opposing ends of the curler arms 32, 34, is also contemplated. Lastly, for any embodiment disclosed here, using the eyelash curler 10 to heat the eyelash while curling allows the user to curl the eyelash without the need for excessive force, thus avoiding unnecessary damage to the eyelash that would result from the excessive force.

It will be understood that eyelash curler implementations are not limited to the specific assemblies, devices and components disclosed in this document, as virtually any assemblies, devices and components consistent with the intended operation of an eyelash curler may be utilized. Accordingly, for example, although particular eyelash curler assemblies, devices and components are disclosed, such may include any shape, size, style, type, model, version, class, measurement, concentration, material, weight, quantity, and/or the like consistent with the intended operation of an eyelash curler implementation. Implementations are not limited to uses of any specific assemblies, devices and components; provided that the assemblies, devices and components selected are consistent with the intended operation of an eyelash curler.

Accordingly, the components defining any eyelash curler implementations may be formed of any of many different types of materials or combinations thereof that can readily be formed into shaped objects provided that the components selected are consistent with the intended operation of an eyelash curler implementation. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof.

For the exemplary purposes of this disclosure, sizing, dimensions, and angles of eyelash curler implementations may vary according to different implementations.

Various eyelash curler implementations may be manufactured using conventional procedures as added to and improved upon through the procedures described here. Some components defining eyelash curler implementations may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that the assembly of eyelash curlers is not limited to the specific order of steps as disclosed in this document. Any steps or sequence of steps of the assembly of eyelash curlers indicated herein are given as examples of possible steps or sequence of steps and not as limitations, since various assembly processes and sequences of steps may be used to assemble eyelash curlers.

The eyelash curler implementations described are by way of example or explanation and not by way of limitation. Rather, any description relating to the foregoing is for the exemplary purposes of this disclosure, and implementations may also be used with similar results for a variety of other applications requiring an eyelash curler.

What is claimed is:

1. An eyelash curler, comprising:

a handle having an elongated shape with a top end and a bottom end opposite the top end, the handle containing a battery compartment adjacent the bottom end with a battery therein;

an actuator embedded within the handle, the actuator having a switch exposed on a surface of the handle and an actuator stem having a top end extending from the switch through the top end of the handle, wherein manipulation of the switch moves the actuator between a first position and a second position; and a curling head having only one support bar centered on and extending upward from the top end of the handle, the curling head further comprising a first curler arm fixedly coupled to an end of the support bar, and a second curler arm coupled to the top end of the actuator stem and slidably attached to the support bar through an attachment guide that directly engages the support bar, wherein each of the first curler arm and the second curler arm has a core formed of a first material and extending along the length of the curler arm and an outer layer formed of a second material and surrounding the core, wherein the first material forming the core is harder than the second material surrounding the core;

wherein when the actuator is in the first position, the second curler arm is in contact with the top end of the handle and when the actuator is in the second position, the second curler arm is in contact with the first curler arm, and wherein the curling head is electrically coupled to the battery and configured to heat when power is supplied to the curling head.

2. The eyelash curler of claim 1, wherein the core of each of the first curler arm and the second curler arm is malleable and configured to assume a new shape in response to pressure applied to either of the first curler arm or the second curler arm.

3. The eyelash curler of claim 1, wherein the curler arms are removable from the curling head.

4. The eyelash curler of claim 1, wherein the second material is a heat-conductive material.

5. The eyelash curler of claim 1, wherein the cores of the first curler arm and the second curler arm are formed of a plurality of core segments pivotally coupled together.

6. The eyelash curler of claim 1, wherein the cores of the first curler arm and the second curler arm are formed of a single, continuous malleable material.

7. The eyelash curler of claim 1, wherein the actuator is biased toward the first position.

8. An eyelash curler, comprising:

a handle having an elongated shape with a top end and a bottom end opposite the top end;

an actuator embedded within the handle, the actuator having a switch exposed on a surface of the handle and an actuator stem having a top end extending from the switch through the top end of the handle, wherein manipulation of the switch moves the actuator between a first position and a second position; and a curling head having only one support bar extending upward from the top end of the handle, the curling head further comprising a first curler arm fixedly coupled to an end of the support bar, and a second curler arm coupled to the top end of the actuator stem and slidably attached to the support bar through an attachment guide that directly engages the support bar, wherein each of the first curler arm and the second curler arm has a core formed of a first material that extends along the length of the curler arm and an outer layer formed of a second material that surrounds the core, wherein the first material forming the core is harder than the second material surrounding the core;

wherein when the actuator is in the first position, the second curler arm is in contact with the top end of the handle and when the actuator is in the second position, the second curler arm is in contact with the first curler arm, and wherein the core of each of the first curler arm and the second curler arm is malleable and configured to assume a new shape in response to pressure applied to either of the first curler arm or the second curler arm.

9. The eyelash curler of claim 8, wherein the curler arms are removable from the curling head.

10. The eyelash curler of claim 8, wherein the cores of the first curler arm and the second curler arm are formed of a plurality of core segments pivotally coupled together.

11. The eyelash curler of claim 8, wherein the cores of the first curler arm and the second curler arm are formed of a single, continuous malleable material.

12. The eyelash curler of claim 8, wherein the actuator is biased toward the first position.

13. The eyelash curler of claim 8, the handle containing a battery compartment adjacent the bottom end with a battery, wherein a charging port in the bottom end of the handle is electrically coupled to the battery and the curling head is electrically coupled to the battery and configured to heat when power is supplied to the curling head.

14. The eyelash curler of claim 13, wherein the second material is a heat-conductive material.

15. An eyelash curler, comprising:

a handle having an elongated shape with a top end and a bottom end opposite the top end;

an actuator embedded within the handle, the actuator having a switch exposed on a surface of the handle and an actuator stem having a top end extending from the switch through the top end of the handle, wherein manipulation of the switch moves the actuator between a first position and a second position; and a curling head having only one support bar extending upward from the top end of the handle, the curling head further comprising a first curler arm coupled to an end of the support bar, and a second curler arm coupled to the top end of the actuator stem, wherein each of the first curler arm and the second curler arm has a core formed of a first material that extends along the length of the curler arm and an outer layer formed of a second material that surrounds the core, wherein the first material forming the core is harder than the second material surrounding the core;

wherein when the actuator is in the first position, the second curler arm is in contact with the top end of the handle and when the actuator is in the second position, the second curler arm is in contact with the first curler arm.

16. The eyelash curler of claim 15, wherein the only one support bar is centered on the top end of the handle.

17. The eyelash curler of claim 15, the handle containing a battery compartment adjacent the bottom end with a battery, wherein a charging port in the bottom end of the handle is electrically coupled to the battery and the curling head is electrically coupled to the battery and configured to heat when power is supplied to the curling head.

18. The eyelash curler of claim 15, wherein the actuator is biased toward the first position.

19. The eyelash curler of claim 15, wherein the second curler arm is slidably attached to the support bar through an attachment guide that directly engages the support bar.

* * * * *